United States Patent [19]

Stotler et al.

[11] Patent Number: 4,600,423

[45] Date of Patent: Jul. 15, 1986

[54] METHOD AND APPARATUS FOR PRODUCING A CONTINUOUS GLASS FILAMENT MAT

[75] Inventors: David V. Stotler; Fred S. Coffey, both of Newark, Ohio

[73] Assignee: Owens-Corning Fiberglas Corporation, Toledo, Ohio

[21] Appl. No.: 729,456

[22] Filed: May 1, 1985

[51] Int. Cl.[4] ..... C03B 37/06

[52] U.S. Cl. ..... 65/4.4; 65/5; 65/9; 65/16

[58] Field of Search ..... 65/4.4, 5, 9, 16

[56] References Cited

U.S. PATENT DOCUMENTS

| | | | |
|---|---|---|---|
| 3,445,207 | 5/1969 | Goerens | 65/9 X |
| 4,337,074 | 6/1982 | Muschelknautz et al. | 65/16 X |
| 4,466,819 | 8/1984 | Dunn | 65/4.4 |
| 4,487,622 | 12/1984 | Baggitelli et al. | 65/4.4 |
| 4,496,384 | 1/1985 | Lin | 65/4.4 |
| 4,496,385 | 1/1985 | Lin | 65/9 |

*Primary Examiner*—Robert Lindsay

*Attorney, Agent, or Firm*—Ronald C. Hudgens; Greg Dziegielewski

[57] ABSTRACT

A method and apparatus for producing a mat of highly dispersed continuous glass filaments at increased throughput while maintaining desirable tensile strength characteristics is provided by means of an oscillatable, fluidic distribution system.

8 Claims, 5 Drawing Figures

METHOD AND APPARATUS FOR PRODUCING A CONTINUOUS GLASS FILAMENT MAT

TECHNICAL FIELD

The invention disclosed herein relates to the production of mats comprised of strands of highly dispersed, continuous glass filaments arranged in an overlapping, interengaging swirled relationship.

BACKGROUND

As with many other processes, the desire to increase the throughput and efficiency of present systems for producing continuous strand mats has been felt. The physical properties of the mat can be greatly affected by increasing the throughput of the feeder, especially in those processes wherein, contemporaneously, continuous glass filaments are produced, gathered into a plurality of bundles and deposited on a moving conveyor as a mat wherein the bundles or strands arranged in a planar array are oscillated back and forth across the width of the conveyor.

For example, by merely increasing the throughput of the fiber forming feeder, the mat produced may have more tensile strength in the cross machine direction as opposed to the machine direction.

The present invention provides a system wherein the throughput of the system can be increased while achieving the desired tensile strength characteristics in a highly dispersed or filamentized mat of continuous glass filaments.

DISCLOSURE OF THE INVENTION

The invention pertains to method and apparatus for forming a mat of continuous glass filaments comprising: supplying a substantially planar band of substantially parallel bundles of continuous filaments; contacting the bundles of filaments with a gaseous stream; creating turbulence in the flow of the stream to separate filaments from the bundles at a first control zone; and then advancing said separated filaments and bundles through a second fluid control zone to further separate filaments from the bundles and to orient the separated filaments and remainder of the bundles as a diverging planar array.

BEST MODE OF CARRYING OUT THE INVENTION

Figure 1:
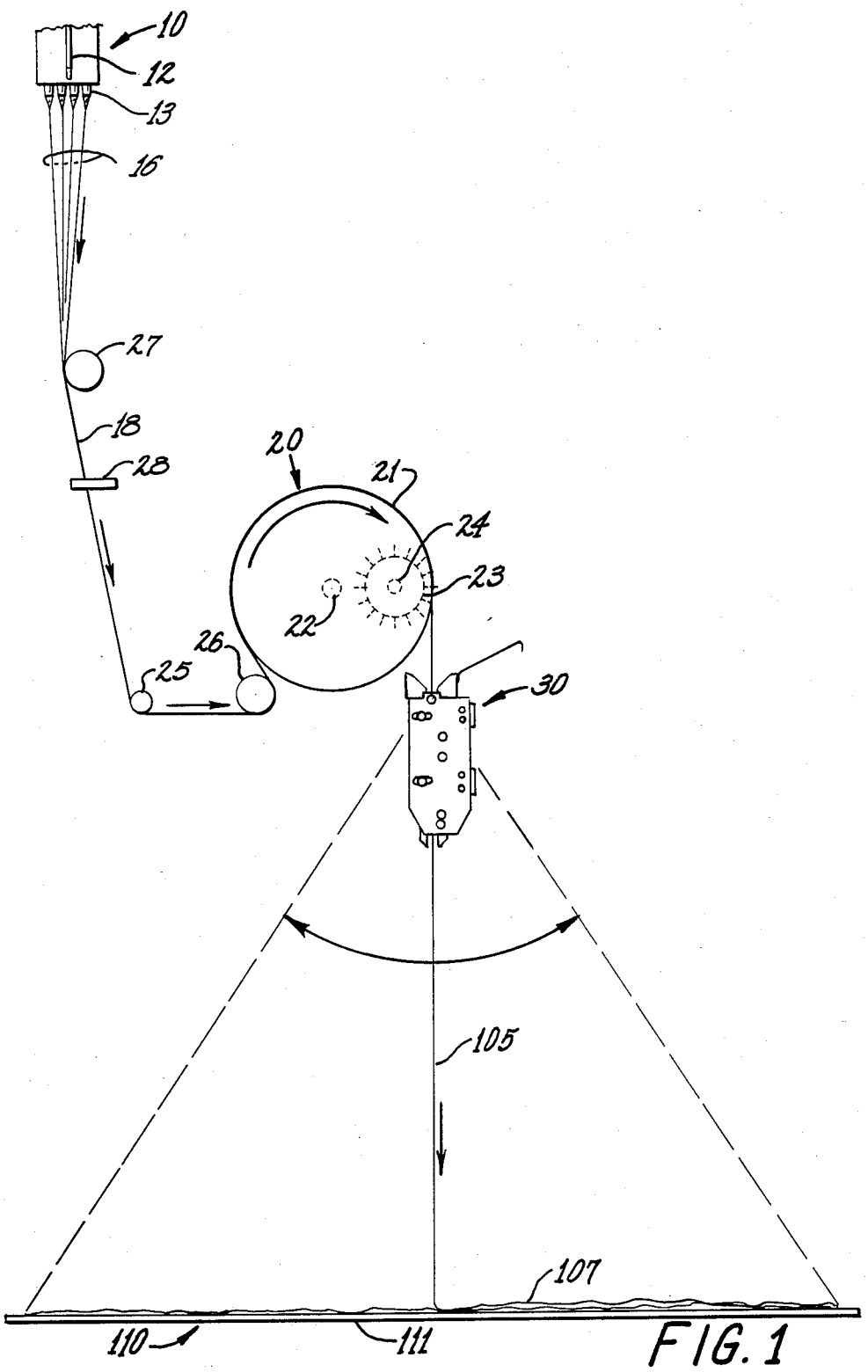
FIG. 1 is an elevational view of a fiber and mat producing system according to the principles of this invention.

As shown in FIG. 1, electrically heated feeder means 10 supplies a plurality of streams of molten inorganic material, such as glass, which are attenuated or drawn into a plurality of continuous filaments 16 through the action of attenuation means 20. Feeder 10 may be of any suitable design. As shown, feeder 10 is equipped with a pair of terminals 12 which are connected to a source of electrical energy (not shown). Further, the discharge or bottom wall is equipped with a plurality of orificed projections 13 to supply the streams of molten material, as is known in the art.

Intermediate feeder 10 and attenuation means 20, a coating means 27 supplies a protective coating or size to the advancing filaments. Downstream of size applicator 27, guide or multi-grooved gathering shoe 28 gathers the plurality of filaments into a plurality of strands or bundles having a plurality of filaments in each strand. Preferably, each strand has about the same number of filaments therein. Also, guide 28 orients the strands into a planar band 18 wherein the strands are spaced apart but substantially parallel to each other.

Attenuation means 20 is comprised of a driven pull roll or wheel 21 having an axis of rotation 22, and spaced therefrom, a spoked wheel or carriage 23 having an axis of rotation 24 which is substantially parallel to axis of rotation 22. Spoked wheel 23 is positioned within pull wheel 21, and the extremities of spoked wheel 23 extend through slots in the circumferential periphery of pull wheel 21 to disengage the band 18 from the surface thereof at a predetermined point. As such, the axes of rotation 22 and 24 are fixed. The circumferential surface of pull wheel 21 is substantially flat and is adapted to maintain the band of strands 18 in a substantially spaced apart but parallel relationship. Idler rolls 25 and 26 serve to orient the band 18, as desired. Desirably, roll 25 has a plurality of parallel circumferential grooves to assist in separating the filament into an array of parallel bundles or strands.

Advancing from the surface of pull wheel 21, the band of strands 18 is distributed as diverging planar array 105 by distribution means 30 which oscillates array 105 across the width of endless foraminous belt 111 of collection means or conveyor 110 to form mat or fibrous body 107 thereon. As shown in FIG. 1, the axis of rotation 22 is substantially parallel to the path of advancement (perpendicular to the plane of FIG. 1) of belt 111, or in other words, a lateral edge of mat 107.

Usually, a single conveyor 110 will be served by a series of feeders, pull wheels and distribution devices (i.e., plurality of "positions") wherein a plurality of diverging planar arrays of strands are deposited across the width of the conveyor to produce a mat 107 of continuous glass strands and/or filaments arranged in overlapping, interengaging, looping or swirled orientation.

Distribution means 30 is a multi-stage system wherein, as a first stage, a first blower means and first fluid effect zone combine to disperse or debundle the bundles of strand into individual filaments or bundles having a smaller number of filaments therein. The second stage of the system is comprised of a second blower means and a second fluid effect zone which combine to further disperse or debundle the remaining bundles of filaments and to impart lateral movement to the bundles and filaments to advance them as a diverging planar array to the collection surface.

Preferably, the design of the instant distribution means generally employs the principles set forth in our currently pending U.S. patent application Ser. No. 721,019, filed Apr. 8, 1985, regarding the first stage and U.S. Pat. No. 4,515,613 issued to us on May 7, 1985 regarding the second stage, both of which are hereby incorporated by reference.

According to the principles of this invention, a diverging planar array 105 of individual filaments or bundles comprised of a smaller number of filaments than the strands entering the distribution means 30 may exhibit a width at the collection surface 111 within the range from about 4 to about 18 times the width of the band of strands 18 entering inlet section 140 of distribution means 30. Such bundles of filaments exiting the distribution means 30 comprised of a substantially smaller number of filaments than the bundles entering distribution means 30, will be, for the purposes of this discussion, termed "mini-strands" or "mini-bundles". Preferably, the width of the diverging array 105 at collection surface 111 is at least six times the width of band 18 at inlet 55, and, more preferably, the width of diverging array 105 at collection surface 111 is within the range from about 6 to about 10 times the width of band 18.

Figure 2:
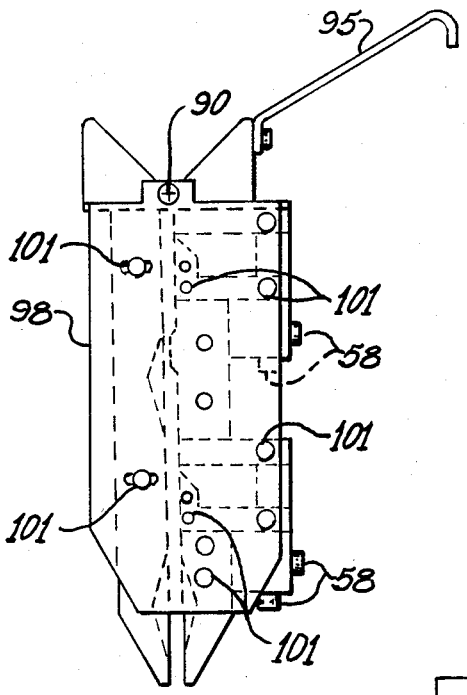
FIG. 2 is an enlarged view of the distribution means shown in FIG. 1.
Figure 3:
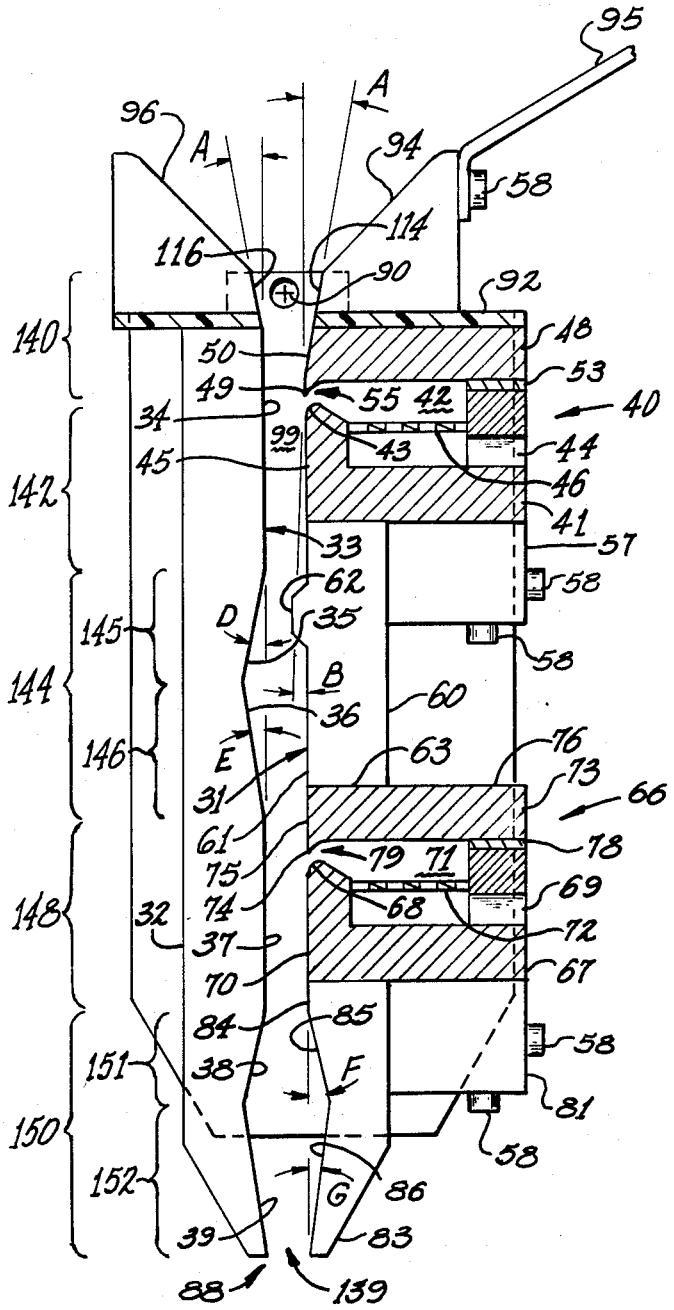
FIG. 3 is an enlarged cross-sectional view of the distribution means shown in FIG. 2.

As shown in FIGS. 2 and 3, distribution means 30 employs a pair of serially arranged fluid supply means or blower assemblies 40 and 66 which are in communication with an articulated chamber 139 primarily defined by first control surface 31 and second control surface 33. As will be explained in more detail later herein, first control surface is formed by portions of first blower assembly 40, first member 60, second blower assembly 66 and second member 83. Second control surface 33 is formed from a one side of element 32 which is positioned opposite first control surface 31. As shown, first control surface 31 and second control surface 33 are slightly convergent. That is, the distance between surface 31 and 33 is slightly greater at inlet section 140 than at the exit section 88 thereof. It is to be understood that other orientations between the surfaces are possible within the scope of the present invention.

Both blower assemblies 40 and 66 are preferably designed according to the principles set forth in U.S. Pat. No. 4,316,731 issued on Feb. 23, 1982 to Lin et al., which is hereby incorporated by reference, to provide a substantially uniform planar gaseous stream according to the Coanda effect substantially parallel to the path of advancement of the filaments and in contact therewith.

First blower assembly 40 is comprised of body 41 and cap 48 forming a cell 42 therebetween. Contoured end 43 of body 41 and contoured lip 49 of cap 50 form nozzle 55 which is in communication with cell 42. Cell 42 is supplied with a pressurized fluid, such as air, via inlet 44 which is in communication with a source of pressurized fluid (not shown). A screen 46 is shown positioned within cell 42 between nozzle 55 and inlet 44 to assist in uniformly distributing the flow of working fluid through nozzle 55. A shim 53 may be positioned between body 41 and cap 48 to adjust the gap of nozzle 55 to adjust the volume of working fluid exiting nozzle 55.

Prior to contacting the working fluid delivered from nozzle 55, the band of strands 18 advance through inlet section 140 which is in part formed by front surface 50 of cap 48 and beveled surfaces 114 and 116 of first deflector 94 and second deflector 96, respectively. Surfaces 114 and 116 are angled outwardly to provide easier access to chamber 139 by band 18 as distribution means is oscillated about axis of rotation 90.

As shown, surfaces 114 and 116 form an angle A with respect to an assumed vertical plane to form tapered inlet section 140 of chamber 139. Preferably, angles A are within the range from about 0° to about 20°, thus producing a total included angle range from about 0° to about 40°. As shown in FIG. 3, angles A are approximately 10°, thus yielding a total included angle of about 20°.

As shown, block 57 is provided to join first member 60 to body 41 such that face 61 of first member 60 continues smoothly from face 45 of body 41 to, in part, define first control surface 31. Block 57 may be secured to body 41 and first member 60 by any suitable means such as fasteners 58.

Extending horizontally across face 61, projection 62 extends into the path of the advancing working fluid and band of strands 18 to create turbulence in the working fluid at the first fluid effect zone 144 to break up or filamentize the bundles of filaments into mini-bundles or even into individual filaments. As shown, projection 62 has a trapezoidal shape, but other configurations are contemplated within the scope of the present invention.

The second stage of the two-stage distribution means 30 is comprised of second fluid supply means or blower assembly 66 and the remainders of first control surface 31 and second control surface 33. The lower portions of control surfaces 31 and 33 form a second fluid effect zone 150 for further debundling or filamentizing the advancing mini-bundles of continuous filaments and to impart lateral movement to the individual filaments and mini-bundles to orient the exiting filaments and mini-bundles as a diverging planar array 105.

Second blower assembly 66 is comprised of a body 67 and cap 73 forming cell 71 therebetween. Similar to the first blower assembly 40, contoured end 68 of body 67 cooperates with contoured lip 74 of cap 73 to form nozzle 79 therebetween to provide a uniform planar stream of working fluid, such as air, substantially parallel to the path of advancement of the filaments to contact the filaments and/or mini-bundles emerging from the first fluid effect zone 144.

Nozzle 79 is in communication with cell 71 which is in communication with inlet 69, and inlet 69 is connected to a suitable source of pressurized gas (not shown) to provide nozzle 79 with a source of working fluid. A screen 72 may be positioned between nozzle 79 and inlet 69 to facilitate the uniform distribution of working fluid along the length of nozzle 79. The top 76 of cap 73 is in abutting relationship with the bottom 63 of first member 60 such that front surface 75 of cap 73 forms a smooth continuous plane with face 61 of first member 60. Cap 73 may be fixedly joined to member 60 by any suitable means.

A shim 78 may be positioned between cap 73 and body 67 to adjust the gap of nozzle 79 as required to adjust the volume of working fluid entering articulated chamber 139 from nozzle 79.

As shown, first blower assembly 40 and second blower assembly 66, and, thus, nozzles 55 and 79, are located at the same side of articulated chamber 139 and, thus, along the same side of the advancing filaments.

Second member 83 is held in abutting engagement with body 67 by means of block 81 and fasteners 58. Face 84 of second member 83 is positioned to extend smoothly from face 70 of body 67 to further define first control surface 31. First surface section 85 recedes from face 84, and second surface section 86 extends from first surface section 85 to complete first control surface 31. As will be explained later herein, surface sections 85 and 86, in part, define second fluid effect zone 150, which orients and further filamentizes the mini-bundles.

As shown, faces 45, 61, 75, 70 and 84 lie in a common substantially flat plane which, in part, define first control surface 31. The flat planar portion of control surface 31 forms an angle B with respect to an assumed vertical plane. Preferably, angle B is within the range from about 0° to about 5°. As shown, angle B is about 1°.

Second control surface 33 is comprised of first, second, third, fourth, fifth and sixth surface sections 34, 35, 36, 37, 38 and 39, respectively. First surface section 34 and fourth surface section 37 lie in a common, substantially flat plane oriented substantially at an angle C with respect to an assumed vertical plane. Preferably, angle C is within the range from about 1° to about 6°. As shown, angle C is about 1.5°. Thus, first control surface 31 and second control surface 33 are convergent. However, it is to be understood that other orientations may be suitable.

Articulated chamber 139, as defined by first and second control surfaces 31 and 33, is comprised of inlet section 140, first throat section 142, first fluid effect zone 144, second throat section 148 and second fluid effect zone 150 which are serially in communication with one another.

As described before, inlet section 140 is formed by surfaces 114 and 116, front surface 50 and a portion of first surface section 34. First throat section 142 is formed between a portion of first surface section 34 and the composite of face 45 and a portion of face 61. The first fluid effect zone 144 is defined by face 61 of first member 60 including projection 62 and surface sections 35 and 36 which form divergent section 145 and convergent section 146, respectively.

Figure 5:
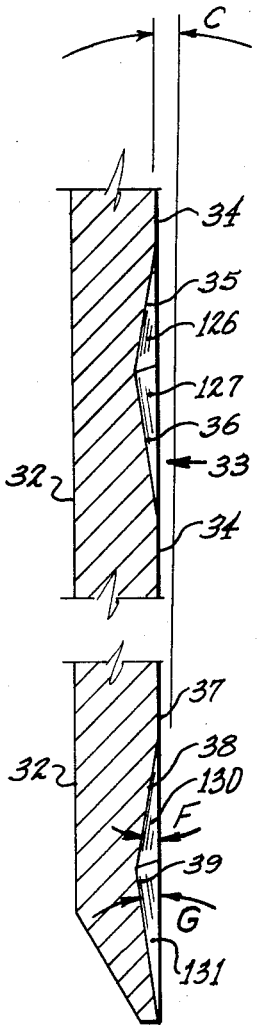
FIG. 5 is an enlarged view of a portion of the distribution means shown in FIG. 3.

Second surface section 35 forms an angle D with respect to the plane defined by surface sections 34 and 37, preferably within the range from about 5° to about 20°. As shown, angle D is about 10°. Further, third surface section 36 forms an angle E with respect to the plane defined by surface sections 34 and 37, that is, the plane of second control surface 33, and is preferably within the range from about 5° to about 25°. As shown in FIGS. 3 and 5, angle E is about 5°.

Second throat section 148 is formed between faces 70 and 84 and opposing fourth surface section 37 of element 32. Second throat section 148 is in communication with second fluid effect zone 150 which is comprised of a divergent section 151 and a convergent section 152. Divergent section 151 is formed between first surface section 85 of second member 83 and fifth surface section 38 of element 32, and convergent section 152 is formed between second surface section 86 of second member 83 and sixth surface section 39 of element 32.

Figure 4:
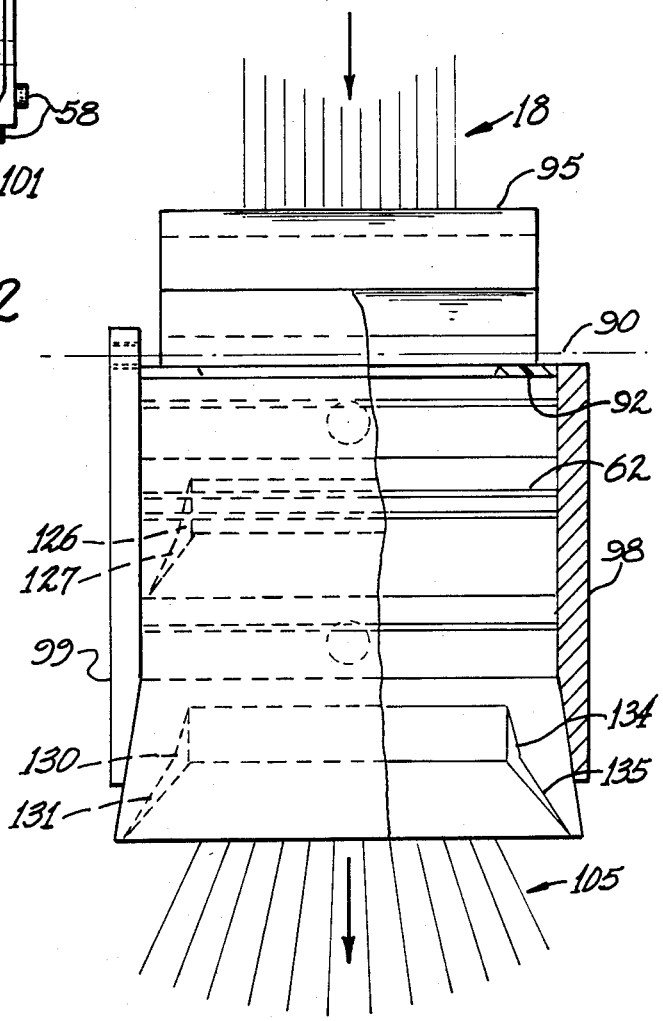
FIG. 4 is a side view of the distribution means shown in FIG. 2.

As shown in FIGS. 4 and 5, that portion of divergent section 145 and convergent section 146 of first fluid effect zone 144 formed in element 32 include lateral surfaces 126 and 127 to form a shovel-shaped pocket or recess in second control surface 33. As shown, divergent section 145 is located immediately opposed to projection 62 of first member 60. Similarly, fifth surface section 38 and sixth surface section 39, first surface section 85 and second surface section 86 of second member 83 terminate at lateral surfaces 134 and 135, respectively, to form a shovel-shaped pocket or recess in second member 83 and first control surface 31.

Fifth surface section 38 forms an angle F with respect to the plane of second control surface 33. Similarly, first surface section 85 of second member 83 forms a corresponding angle F with respect to the plane of first control surface 31. Preferably, angles F are within the range from about 5° to about 20°. As shown, each angle F is about 10°.

Sixth surface section 39 forms an angle G with respect to the plane of second control surface 33. Similarly, second surface section 86 of second member 83 forms an angle G with respect to the plane of first control surface 31. Angles G should be within the range from about 5° to about 25°. As shown, each angle G is about 5°.

The divergent and then convergent configuration of second fluid effect zone 150 serves to urge the working fluid emitted from nozzles 55 and 75 and, thus, the filaments and mini-bundles advancing therewith, laterally outward to form diverging array 105. As pointed out before, the second fluid effect zone also increases the filamentization or debundling of the strands to provide an even more disbursed or highly filamentized mat of continuous glass filaments having good tensile strength in any direction within the plane of mat 107, especially along the length of mat 107 as well as across the width of mat 107.

The diverging, then converging, configuration of the second fluid effect zone 150 reduces the velocity of the gaseous stream exiting from distribution means to permit the distribution means 30 to be placed closer to collection means 110 than would generally be possible without such a configuration and, in parts, lateral movement to the bundles of filaments to eject the mini-bundles and filaments from distribution means as the aforementioned diverging planar array.

In operation, it has been found that it is desirable to provide a greater volume of air from nozzle 55 than that volume of air supplied from nozzle 79. However, it is to be understood that the volume of air from nozzle 79 may be equal to or greater than that supplied from nozzle 55, if desired.

The lateral edges of articulated chamber 139 are defined by first end plate 98 and second end plate 99 as shown in FIGS. 2 and 4. End plates 98 and 99 may be fastened to element 32, first blower assembly 40, second blower assembly 66, first member 60 and second member 83 as desired, such as, by means of threaded fasteners 101. Further, plates 98 and 99 are slotted at attachment points to element 32 to provide adjustability with regard to spacing between first control surface 31 and second control surface 33 as well as the relative angle therebetween.

For ease in mounting first deflector 94 and second deflector 96 to the system, mounting plate 92 is secured to first blower assembly 40, element 32 and deflectors 94 and 96 by mechanical fasteners. Deflectors 94 and 96 assist in guiding the band of strands 18 into inlet section 140. Further, extension 95, which is attached to deflector 94 by means of fasteners 58, assist in guiding "heavy" bundles of strand that may be thrown off pull wheel 21 at too early of a point into inlet 140.

Distribution means 30 is pivotal about axis of rotation 90 to direct the gaseous stream and array of mini-bundles or filaments back and forth across the width of conveyor belt 111 as shown in FIG. 1. It is preferred that the axis of rotation 90 of distribution means 30 be oriented substantially parallel to and in line with the center line of inlet 140 to provide uninterrupted access to distribution means 30 by the band of strands 18 throughout the complete arc of oscillation of distribution means 30.

As shown, distribution means 30, which may be driven for movement by any suitable means (not shown), is oscillated about an axis substantially parallel to the path of advancement of conveyor belt 111 to distribute the diverging planar array of filaments and mini-bundles 105 across the width of mat 107. However, it is to be understood that the axis of rotation of distribution means 30 may be obliquely oriented with respect to the path of advancement of conveyor belt 111 to produce a mat of different physical characteristics if desired.

As is known in the art, mat 107 may receive a suitable binder to adhere the mini-bundles and filaments to one another to form a unitary fibrous body. For example, see U.S. Pat. Nos. 3,442,751 and 2,875,503. Or, mat 107 may be needlepunched to provide sufficient integrity.

Preferably, distribution means 30 is made from lightweight materials, such as aluminum, to reduce the mass of the system that must be reciprocably moved. Coatings, however, may be applied to the strand contacting surfaces to reduce friction and surface wear as well as filament abrasion, if desired.

It is apparent that within the scope of the present invention, modifications and different arrangements can be made other than as herein disclosed. The present disclosure is merely illustrative with the invention comprehending all variations thereof.

INDUSTRIAL APPLICABILITY The invention disclosed herein is readily applicable to the glass fiber mat industry.

We claim:

1. Apparatus for producing a mat of continuous glass filaments comprising:

feeder means for supplying a plurality of streams of molten glass;

continuation means for drawing the streams into continuous filaments;

means for orienting the advancing filaments as an array of substantially parallel bundles of filaments;

distribution means comprising: a first control surface and a second control surface defining an articulated chamber adapted to receive the array of advaning filaments; a first blower assembly adapted to supply a substantially planar first stream of gas into the chamber along the path of advancement of the bundles; a second blower assembly adapted to supply a substantially planar second stream of gas into the chamber along the path of advancement of the filaments, a portion of the first and second control surfaces having divergent and convergent sections defining a first fluid effect zone in said chamber adapted to create turbulence in said gaseous stream sufficient to disassociate filaments from the bundles, said first fluid effect zone being located intermediate said first blower assembly and said second blower assembly, another portion of the first and second control surfaces having divergent and convergent sections defining a second fluid effect zone in said chamber adapted to laterally extend the gaseous body formed by said first and second gaseous streams sufficient to further separate additional filaments from the bundles and to orient the separated filaments and remaining bundles as a diverging planar array; and means for collecting the filaments and bundles to form said mat.

2. The apparatus of claim 1 wherein said first control surface and said second control surface are convergent with respect to one another.

3. The apparatus of claim 1 wherein said first control surface has a projection extending into the path of advancement of the bundles of filaments and working fluid at the first fluid effect zone.

4. The apparatus of claim 1 further comprising a first end plate and a second end plate abutting said first control surface and said control surface to further define said articulated chamber.

5. A method of forming a mat of continuous glass filaments comprising:

supplying a plurality of streams of molten glass;

drawing the streams into continuous filaments;

orienting the advancing filaments as an array of substantially parallel bundles of filaments;

directing the array of bundles into a distribution means comprising: a first control surface and a second control surface defining an articulated chamber adapted to receive the array of advancing filaments; a first blower assembly adapted to supply a substantially planar first stream of gas into the chamber along the path of advancement of the bundles; a second blower assembly adapted to supply a substantially planar second stream of gas into the chamber along the path of advancement of the filaments, a portion of the first and second control surfaces having divergent and convergent sections defining a first fluid effect zone in said chamber adapted to create turbulence in said gaseous stream sufficient to disassociate filaments from the bundles, said first fluid effect zone being located intermediate said first blower assembly and said second blower assembly, another portion of the first and second control surfaces having divergent and convergent sections defining a second fluid effect zone in said chamber adapted to laterally extend the gaseous body formed by said first and second gaseous streams sufficient to further separate additional filaments from the bundles and to orient the separated filaments and remaining bundles as a diverging planar array; and collecting the filaments and bundles to form said mat.

6. The method of claim 5 wherein the first and second streams of gas are supplied from the same side of the advancing filaments and bundles.

7. The method claim 5 wherein the volume of the first stream of gas is greater than the volume of the second stream of gas.

8. The method of claim 5 further comprising locating a projection extending into the first fluid effect zone in the path of the advancing bundles and first stream of gas to enhance the creation of turbulence therein.

* * * * *